US007313987B1

(12) United States Patent
Chen

(10) Patent No.: US 7,313,987 B1
(45) Date of Patent: Jan. 1, 2008

(54) RATCHET TOOL

(75) Inventor: Chiu-Tang Chen, Kaohsiung Hsien (TW)

(73) Assignee: Cheng-Tsan Hu, Tainan Hsien (TW)

( * ) Notice: Subject to any disclaimer, the term of this patent is extended or adjusted under 35 U.S.C. 154(b) by 0 days.

(21) Appl. No.: 11/555,719

(22) Filed: Nov. 2, 2006

Related U.S. Application Data

(63) Continuation-in-part of application No. 11/428,773, filed on Jul. 5, 2006, now Pat. No. 7,263,918.

(51) Int. Cl.
*B25B 13/46* (2006.01)

(52) U.S. Cl. ..... 81/63.1; 192/43.2

(58) Field of Classification Search ..... 81/63.1, 81/62; 192/43.2
See application file for complete search history.

(56) References Cited

U.S. PATENT DOCUMENTS 2,193,984 A * 3/1940 Rhinevault ..... 192/43.2
2006/0207392 A1* 9/2006 Lai ..... 81/61

* cited by examiner

*Primary Examiner*—D. S. Meislin
(74) *Attorney, Agent, or Firm*—WPAT, PC

(57) ABSTRACT

A ratchet tool includes a handle, a tooling sleeve, a first pawl, a first elastic member, a second pawl, a second elastic member, a retaining ring, and a dialer. The outer circumference of the tooling sleeve received in the handle is disposed with teeth. The pawls and the elastic members are contained in the handle. Each of the pawls is disposed with teeth and a post. The retaining ring covers up the pawls and the elastic members and is secured to the handle. The dialer is pivoted to the retaining ring to change work direction of the tooling sleeve by moving the pawls as driven by the posts linked to the dialer when the dialer is turned to either side.

8 Claims, 5 Drawing Sheets

RATCHET TOOL

CROSS-REFERENCE TO RELATED APPLICATIONS

This application is a continuation-in-part of my application filed Jul. 5, 2006, Ser. No. 11/428,773 now U.S. Pat. No. 7,263,918, which is incorporated herein by reference in its entirety.

BACKGROUND OF THE INVENTION (a) Field of the Invention

The present invention relates to a ratchet tool, and more particularly to one that allows change work direction of a tooling sleeve by turning a dialer to either side to cause its retaining block to drive the post of either pawl thus to disengage the pawl from the teeth of tooling sleeve.

(b) Description of the Prior Art

There are many types of ratchet tools generally available in the market with each giving own characteristics. As taught in U.S. Pat. No. 5,875,693, a hand ratchet tool operates on a gear to engage for locating; however, its locating structure for changing work direction is not properly designed and is also vulnerable to damage.

SUMMARY OF THE INVENTION

The primary purpose of the present invention is to provide a ratchet tool that allows to change work direction of a tooling sleeve by turning a dialer to either side to cause its retaining block to drive the post of either pawl to disengage the pawl from the teeth of the tooling sleeve to solve the problems of improper design of direction changing and comparatively shorter service life found with the prior art.

To achieve the purpose, the present invention includes a handle, a tooling sleeve, a first pawl, a first elastic member, a second pawl, a second elastic member, a retaining ring, and a dialer. The handle comprises a chamber and a pair of recesses adjacent to the chamber. The tooling sleeve comprises an insertion hole and teeth disposed on the outer circumference of the tooling sleeve. The tooling sleeve is contained in chamber of the handle. The first pawl received in one of the recesses of the handle is disposed with teeth corresponding to the teeth of the tooling sleeve and a first post. The first elastic member holds against the first pawl and the recess containing the first pawl. The second pawl received in the other of the recesses of the handle is provided with teeth corresponding to the teeth of the tooling sleeve and a second post. The second elastic member holds against the second pawl and the recess containing the second pawl. The retaining ring is placed and secured with a locking member over the first pawl, the first elastic member, the second pawl, and the second elastic member. The dialer is provided with a retaining block pivoted to the retaining ring and holding against the first post and the second post. Wherein a groove is disposed in the handle and the locking member is a C-shaped clamp inserted in the groove.

Another embodiment of the present invention includes a handle, a tooling sleeve, a first pawl, a first elastic member, a second pawl, a second elastic member, a retaining ring, and a dialer. The handle comprises a chamber, a pair of recess, a platform, a bore, and a stopper. The platform is adjacent to recesses. The bore is disposed near the platform and contains the stopper. The stopper pushes against an opening end of the bore. The retaining ring is further disposed with a limiting ring corresponding to the platform and the recesses.

A limiting groove is disposed in the limiting ring. The dialer comprises a dialing handle, a retaining block and a locking bolt. The locking bolt is to pivot the dialer to the retaining ring. The retaining block comprises a first ear and a second ear. The first ear holds against the first post of the first pawl and the second post of the second pawl, and the second ear is to be contained in the limiting groove.

Wherein the stopper pushes against an opening end of the bore by means of a third elastic member; the locking bolt is secured in place by means of a rivet or alternatively by means of a bolt and a nut; the dialing handle of the dialer is further disposed with a plurality of locating recesses corresponding to the stopper of the handle. The number of the locating recesses on the dialing handle of dialer may be of three or two. Accordingly, the present invention provides the advantages of precise locating operation in changing work direction and better withstanding normal tear and wear.

DETAILED DESCRIPTION OF THE PREFERRED EMBODIMENTS

Figure 1:
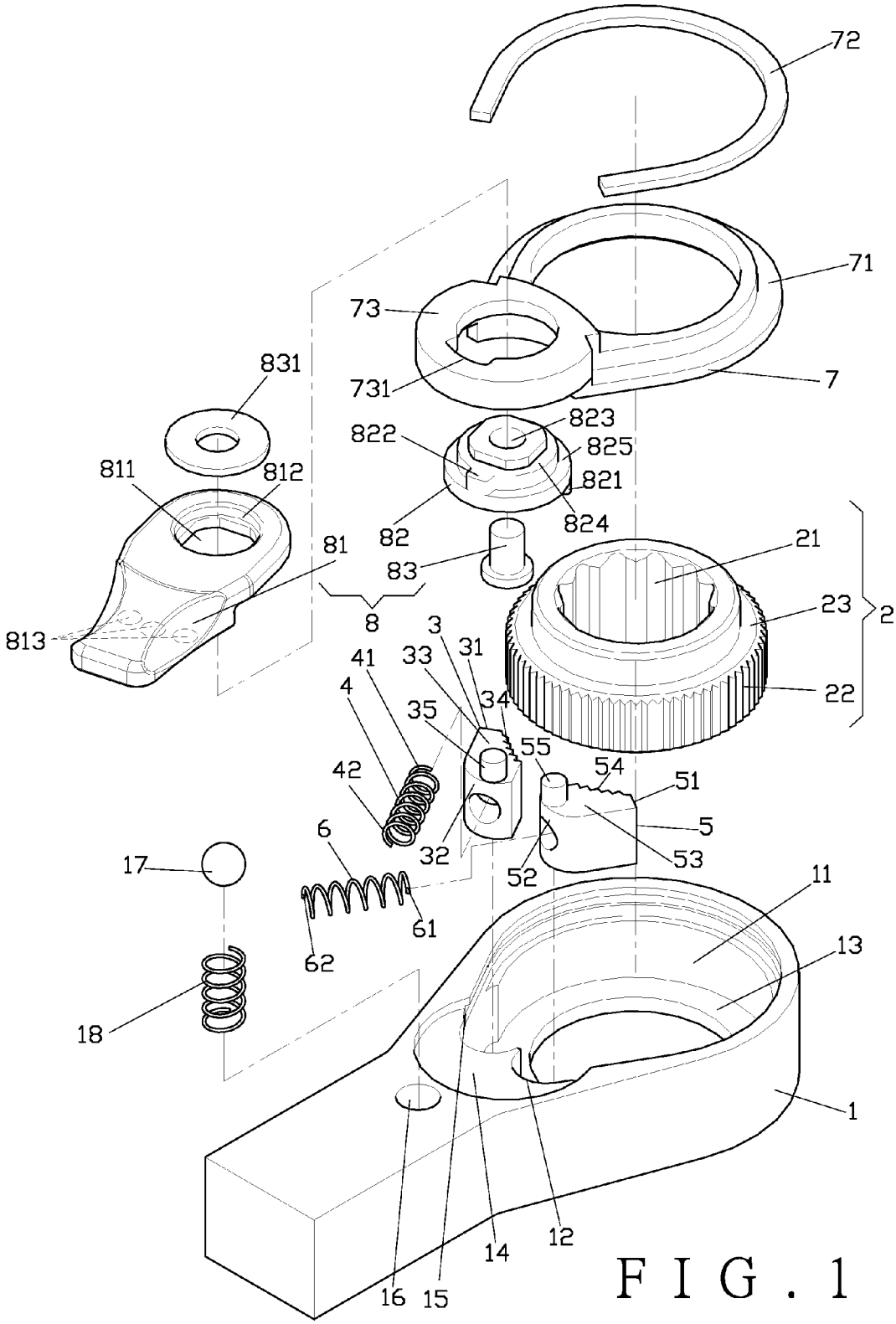
FIG. 1 is an exploded view of a preferred embodiment of the present invention.
Figure 2:
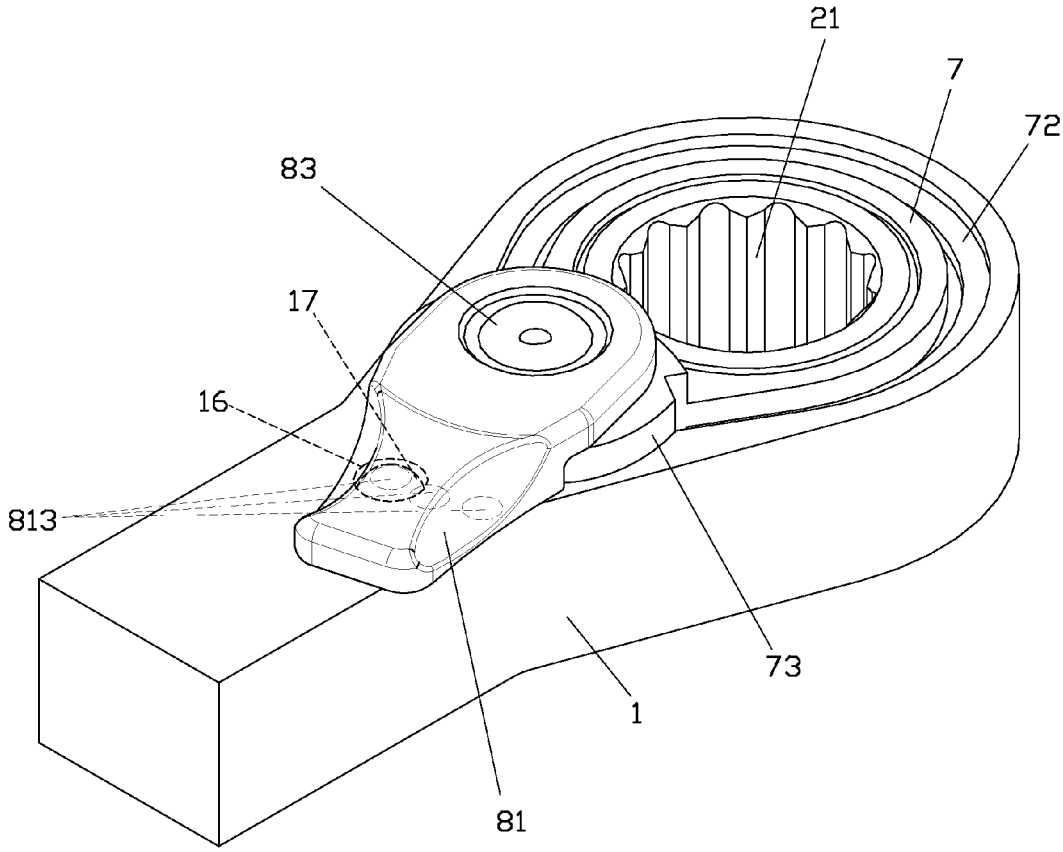
FIG. 2 is a perspective view of an assembly of the preferred embodiment of the present invention.

Referring to FIGS. 1 and 2, a preferred embodiment of the present invention comprises a handle (1), a tooling sleeve (2), a first pawl (3), a first elastic member (4), a second pawl (5), a second elastic member (6), a retaining ring (7), and a dialer (8).

The handle (1) comprises a chamber (11) and a pair of recesses (12). The recesses (12) are adjacent to the chamber (11). The tooling sleeve (2) received in the chamber (11) of the handle (1) comprises an insertion hole (21), and the outer circumference of the tooling sleeve (2) is disposed with teeth (22). The first pawl (3) is contained in one of the recesses (12) of the handle (1). The first pawl (3) comprises teeth (34) corresponding to the teeth (22) of the tooling sleeve (2) and a first post (35). The first elastic member (4) holds against the first pawl (3) and the recess (12) containing the first pawl (3). The second pawl (5) is contained in the other of the recesses (12) of the handle (1). The second pawl (5) comprises teeth (54) corresponding to the teeth (22) of the tooling sleeve (2) and a second post (55). The second elastic member (6) holds against the second pawl (5) and the recess (12) containing the second pawl (5). The retaining ring (7) covers up the first pawl (3), the first elastic member (4), the second pawl (5), and the second elastic member (6). The retaining ring (7) is then secured with a locking member (72). The dialer (8) comprises a dialing handle (81) and a retaining block (82). The retaining block (82) is pivoted to the retaining ring (7) and holds against the first post (35) and the second post (55).

The handle (1) is provided with a groove (15). The locking member (72) is a C-shaped clamp inserted to the groove (15) of the handle (1).

Figure 4:
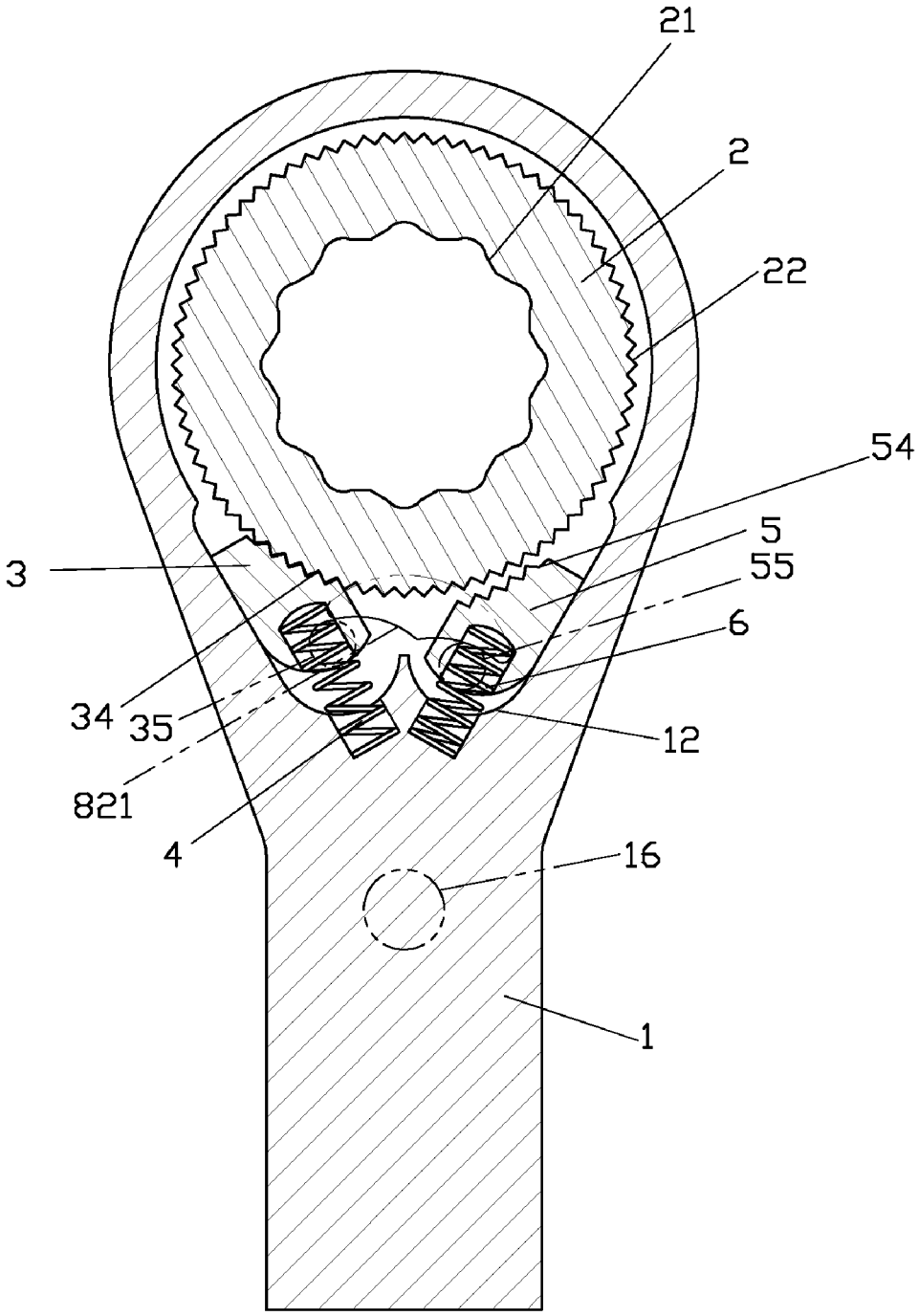
FIG. 4 is a schematic view showing an operation of the locking mechanism executed clockwise of the preferred embodiment of the present invention (showing a cross section/tool head linked clockwise to the handle).
Figure 5:
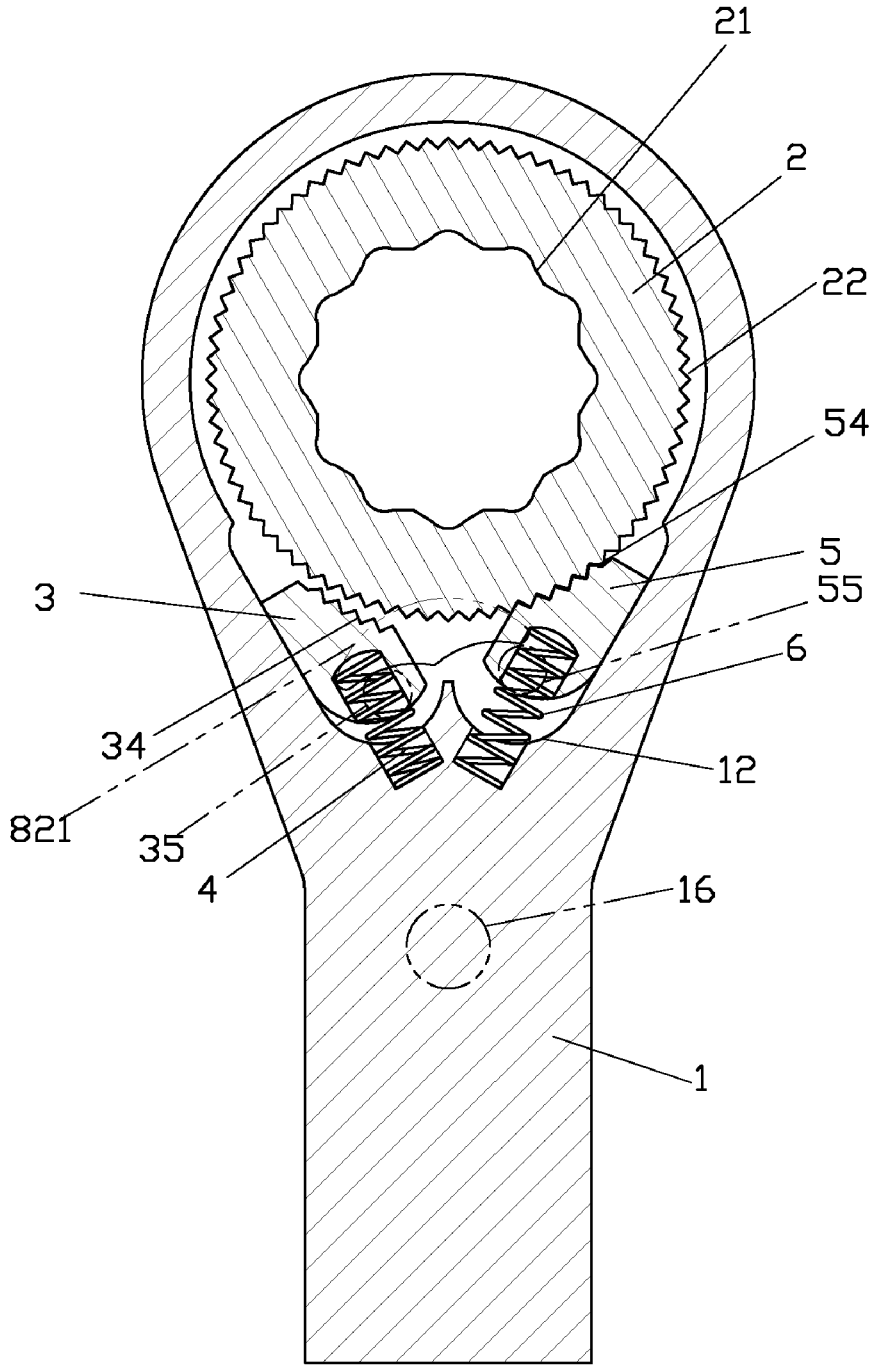
FIG. 5 is a schematic view showing an operation of the locking mechanism executed counterclockwise of the preferred embodiment of the present invention (showing a cross section/tool head linked counterclockwise to the handle).

Accordingly, when the dialer (8) is pushed to either side, the work direction is changed as illustrated in FIGS. 4 and 5. With the dialer (8) pushed to its either side, either of the first post (35) or the second post (55) linked to the retaining block (82) retreats to withdraw either the first pawl (3) or the second pawl (5) while either of the teeth (34) or the teeth (54) to clear away from engaging the teeth (22) of the tooling sleeve (2) thus to precisely change its work direction. When the dialing handle (81) of the dialer (8) is located at its central position, the tooling sleeve (2) is stuck to disable the teeth to render the ratchet tool of the present invention as a conventional tool to turn in any direction as guided by the direction of the force applied.

Referring to FIGS. 1 and 2, the detailed structure of the preferred embodiment of the present invention comprises the handle (1), the tooling sleeve (2), the first pawl (3), the first elastic member (4), the second pawl (5), the second elastic member (6), the retaining ring (7), and the dialer (8).

The handle (1) comprises the chamber (11), the recesses (12), a ring retainer (13), a platform (14), the groove (15), a bore (16), and a stopper (17). The recesses (12) are adjacent to the chamber (11). The ring retainer (13) is disposed at the bottom of the chamber (11). The groove (15) is located in an upper portion of the chamber (11). The platform (14) is adjacent to the recesses (2). The bore (16) is disposed on the handle (1) near the platform (14). The bore (16) contains the stopper (17), and the stopper (17) pushes against the opening of the bore (16) by means of a third elastic member (18).

The tooling sleeve (2) received in the chamber (11) on top of the ring retainer (13) of the handle (1) comprises the insertion hole (21) to secure a tool head (not illustrated) and the teeth (22) and a first gradation (23) to its outer circumference.

The first pawl (3) is a block received in one of the recesses (12) of the handle (1), and comprises a front end (31) and a rear end (32) with a horizontal plane (33) defined between the front end (31) and the rear end (32). The front end (31) is provided with the teeth (34) corresponding to the teeth (22) of the tooling sleeve (2). The first post (35) extends from the horizontal plane (33).

The first elastic member (4) has a first end (41) and a second end (42) opposite to each other. The first end (41) holds against the rear end (32) of the first pawl (3) and the second end (42) holds against the recess (12) containing the first pawl (3).

The second pawl (5) is a block received in the other of the recesses (12) of the handle (1), and comprises a front end (51) and a rear end (52) with a horizontal plane (53) defined between the front end (51) and the rear end (52). The front end (51) is provided with the teeth (54) corresponding to the teeth (22) of the tooling sleeve (2). The second post (55) extends from the horizontal plane (53).

The second elastic member (6) has a first end (61) and a second end (62) opposite to each other. The first end (61) holds against the rear end (52) of the second pawl (5) and the second end (62) holds against the recess (12) containing the second pawl (5).

The retaining ring (7) comprises a second gradation (71) and a limiting ring (73) corresponding to the platform (14) and the recesses (12) of the handle (1). The limiting ring (73) is disposed with a limiting groove (731). The retaining ring (7) covers up the first pawl (3), the first elastic member (4), the second pawl (5), and the second elastic member (6) in conjunction with the locking member (72) inserted in the groove (15) of the handle (1) to secure the retaining ring (7) in the handle (1). The locking member (72) is a C-shaped clamp.

The dialer (8) comprises the dialing handle (81), the retaining block (82) and a locking bolt (83). The dialing handle (81) comprises a through hole (811), a third gradation (812), and a plurality of locating recesses (813) corresponding to the stopper (17). In this embodiment, three locating recesses are disposed. When operation clockwise only, both directions, and operation counterclockwise only are desired to drive for locating by the tooling sleeve (2), three locating recesses (813) are disposed on the dialing handle (81). If the tooling sleeve (2) will be driven only in operation clockwise or counterclockwise, two locating recesses (813) are disposed on the dialing handle (81). The retaining block (82) comprises a first ear (821), a second ear (822), a through hole (823), a fourth gradation (824), and a fifth gradation (825). The first ear (821) holds against the first post (35) and the second post (55), and the second ear (822) is contained in the limiting groove (731). The fifth gradation (825) of the retaining block (82) holds against the limiting ring (73), and the fourth gradation (824) holds against the dialing handle (81). The locking bolt (83) passes through a packing ring (831), and the through hole (823) of the retaining block (82) to connect the dialer (8) to the limiting ring (73). The locking bolt (83) may be a rivet or a screw adapted with a nut. With the locking bolt (83) related to a rivet, its original condition is as illustrated in FIG. 1; however, upon assembling, the locking bolt (83) penetrates from the bottom through the retaining block (82) and the packing ring (831) before punching the upper end of the locking bolt (83) to form a nut for riveting thus to pivot the retaining block (82) and the packing ring (831) into the limiting ring (73).

Upon assembling, the tooling sleeve (2) is received on the ring retainer (13) in the chamber (11) of the handle (1). The recesses (12) accommodate the first pawl (3), the first elastic member (4), the second pawl (5), and the second elastic member (6). The dialer (8) is assembled to the limiting ring (73), and is pivoted to the limiting ring (73) by means of the locking bolt (83). Finally, the retaining ring (7) covers up the first pawl (3), the first elastic member (4), the second pawl (5), and the second elastic member (6) to hold with the dialing handle (81) against the stopper (17). The locking member (72) is inserted into the groove (15) to secure the retaining ring (7) to the handle (1).

Figure 3:
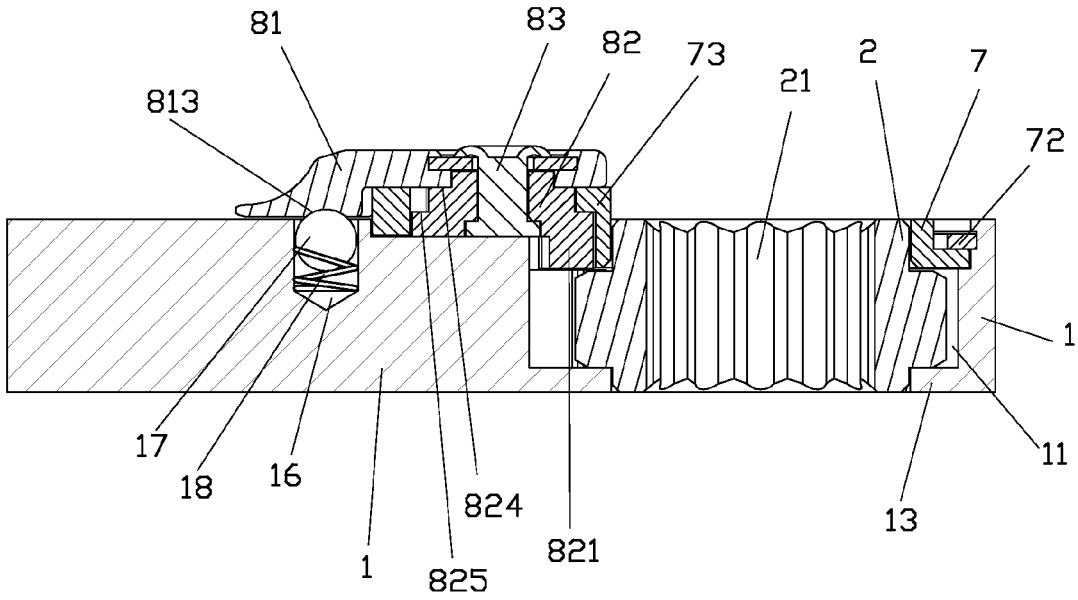
FIG. 3 is a cross-sectional view of the preferred embodiment of the present invention (showing a schematic view of a dialer and its associate locking mechanism).

The first ear (821) of retaining block (82) correspondingly holds against the first post (35) and the second post (55), and the second ear (822) is confined in the limiting groove (731) to restrict the pivoting angle of the retaining block (82). As illustrated in FIG. 3, the third elastic member (18) pushes the stopper (17) to hold against one of the locating recesses (813) of the dialing handle (81) so that the stopper (17) is secured in position when changing the work direction by dialing the dialing handle (81) to either side.

Accordingly, upon changing the work direction as illustrated in FIGS. 4 and 5, when the dialing handle (81) is pushed to either side, either the first post (35) or the second post (55) linked to the retaining block (82) retreats to further withdraw the first pawl (3) or the second pawl (5) and to clear the teeth (34) or the teeth (54) from engaging the teeth (22) of the tooling sleeve (2) to precisely change the work direction of the tooling sleeve (2). With the dialing handle (81) located its central position, the tooling sleeve (2) is stuck without the function of the ratchet and to render the ratchet tool as a conventional tool to work in any direction by compromising the force applied.

As illustrated in FIG. 4 for a schematic view showing the locking operation clockwise of the present invention (a cross-sectional view of a tool head and the handle operate clockwise), the dialer (8) is pushed to its side clockwise, the second post (55) linked to the retaining block (82) moves to clear the teeth (54) of the second pawl (5) from engaging the teeth (22) of the tooling sleeve (2); meanwhile, the handle (1) is turned clockwise for the tooling sleeve (2) to hold against the first pawl (3), and the rear end (32) of the first pawl (3) holds against the inner wall of the recess (12) to drive the tool head (not illustrated) inserted in the tooling sleeve (2) to turn clockwise. When the handle (1) is turned counterclockwise, the tooling sleeve (2) retracts the first pawl (3) thus to idle the tooling sleeve (2) and the tool head (not illustrated) inserted in the tooling tool (2). In the real situation, both the tool head and the tooling sleeve (2) stop at fixed points without turning. As illustrated in FIG. 5 for a schematic view showing the locking operation counterclockwise of the present invention (a cross sectional view of a tool head and the handle operate counterclockwise), the operating principle is similar to that as illustrated in FIG. 4, thus will not be elaborated here.

Thus, specific embodiments and applications of ratchet tool have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A ratchet tool comprising:

a handle comprising a chamber, a pair of recesses, a ring retainer, a platform, a groove, a bore, and a stopper; the recesses being adjacent to the chamber, the ring retainer being disposed in a lower portion of the chamber, the groove being disposed in an upper portion of the chamber, the platform being adjacent to the recesses, the bore being disposed near the platform, the bore containing the stopper, and the stopper pushing against an opening end of the bore;

a tooling sleeve received on the ring retainer in the chamber of the handle comprising an insertion hole and being disposed with teeth and a first gradation on its outer circumference;

a first pawl received in one of the recesses of the handle comprising a front end and a rear end with a horizontal plane defined between the front end and the rear end, the front end being provided with teeth corresponding to the teeth of the tooling sleeve, and a first post extending from the horizontal plane;

a first elastic member having a first end and a second end opposite to each other, the first end holding against the rear end of the first pawl and the second end holding against the recess containing the first pawl;

a second pawl received in the other of the recesses of the handle comprising a front end and a rear end with a horizontal plane defined between the front end and the rear end, the front end being provided with teeth corresponding to the teeth of the tooling sleeve, and a second post extending from the horizontal plane;

a second elastic member having a first end and a second end opposite to each other, the first end holding against the rear end of the second pawl and the second end holding against the recess containing the second pawl;

a retaining ring comprising a second gradation, a limiting ring corresponding to the platform and the recesses, a limiting groove being provided in the limiting ring, the limiting ring covering up the first pawl, the first elastic member, the second pawl, and the second elastic member, the retaining ring being secured to the handle in conjunction with a locking member inserted into the groove of the handle; and a dialer comprising a dialing handle, a retaining block, and a locking bolt, the dialing handle comprising a through hole and a third gradation, the retaining block comprising a first ear, a second ear, a through hole, a fourth gradation, and a fifth gradation, the first ear holding against the first post and the second post, the second ear being contained in the limiting groove, the fifth gradation of the retaining block holding against the limiting ring, the fourth gradation holding against the dialing handle, and the locking bolt penetrating a packing ring and the through hole of the retaining block to connect the dialer to the limiting ring.

2. The ratchet tool as claimed in claim 1, wherein the stopper pushes against an opening end of the bore by means of a third elastic member.

3. The ratchet tool as claimed in claim 1, wherein the locking member is a C-shaped clamp.

4. The ratchet tool as claimed in claim 1, wherein the locking bolt is a rivet.

5. The ratchet tool as claimed in claim 1, wherein the locking bolt is a screw in conjunction with a nut.

6. The ratchet tool as claimed in claim 1, wherein the dialing handle of the dialer is disposed with a plurality of locating recesses corresponding to the stopper of the handle.

7. The ratchet tool as claimed in claim 6, wherein the dialing handle of the dialer is disposed with three locating recesses.

8. The ratchet tool as claimed in claim 6, wherein the dialing handle of the dialer is disposed with two locating recesses.

* * * * *